US009019317B2

(12) United States Patent
Lee et al.

(10) Patent No.: US 9,019,317 B2
(45) **Date of Patent: *Apr. 28, 2015**

(54) LIQUID CRYSTAL DISPLAY AND METHOD FOR DRIVING THE SAME

(75) Inventors: Sunhwa Lee, Gyeonggi-do (KR); Joonkyu Park, Gyeonggi-do (KR); Kiduk Kim, Gyeonggi-do (KR); Jonghoon Kim, Seoul (KR); Jayoung Pyun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 474 days.

This patent is subject to a terminal disclaimer.

(21) Appl. No.: 12/777,793

(22) Filed: May 11, 2010

(65) Prior Publication Data

US 2011/0096101 A1 Apr. 28, 2011

(30) Foreign Application Priority Data

Oct. 23, 2009 (KR) ..... 10-2009-0101429
Mar. 17, 2010 (KR) ..... 10-2010-0023893

(51) Int. Cl.
*G09G 5/10* (2006.01)
*G09G 3/34* (2006.01)
(Continued)

(52) U.S. Cl.
CPC ..... *G09G 3/3406* (2013.01); *G09G 2320/0252* (2013.01); *G09G 2310/0237* (2013.01);
(Continued)

(58) Field of Classification Search
CPC ..... G09G 3/3406; G09G 2340/0435; G09G 2310/061; G09G 2320/0252; G09G 3/2025; G09G 2360/16; G09G 3/2022; G09G 3/3233; G09G 2320/0261; G09G 2320/0646; G09G 2360/18; G09G 2310/0237; G09G 2320/026
USPC ..... 345/50, 87, 88, 89, 90, 102, 207, 77
See application file for complete search history.

(56) References Cited

U.S. PATENT DOCUMENTS

2001/0052886 A1* 12/2001 Ikeda ..... 345/87
2002/0003522 A1* 1/2002 Baba et al. ..... 345/89
(Continued)

FOREIGN PATENT DOCUMENTS

CN 1713031 A 12/2005
CN 1928961 A 3/2007
(Continued)

OTHER PUBLICATIONS

Chinese Office Action (Application No. 201010502123.7, dated Jul. 11, 2012.
(Continued)

*Primary Examiner* — Michael J Eurice
(74) *Attorney, Agent, or Firm* — Morgan, Lewis & Bockius LLP

(57) ABSTRACT

A liquid crystal display includes a liquid crystal display panel including data lines and gate lines, a data driving circuit configured to drive the data lines, a gate driving circuit configured to drive the gate lines, a timing controller configured to divide a unit frame period into a first sub-frame period and a second sub-frame period, a backlight unit configured to provide light to the liquid crystal display panel wherein the backlight unit includes a plurality of light sources, and a light source driving circuit configured to turn off all the plurality of light sources during the first sub-frame period and turns on all the plurality of light sources at a turn-on time within the second sub-frame period.

10 Claims, 9 Drawing Sheets

(51) Int. Cl.
*G09G 3/32* (2006.01)
*G09G 3/20* (2006.01)

(52) U.S. Cl.
CPC ..... *G09G2340/0435* (2013.01); *G09G 2320/0646* (2013.01); *G09G 3/3233* (2013.01); *G09G 2360/18* (2013.01); *G09G 3/2022* (2013.01); *G09G 2360/16* (2013.01); *G09G 3/2025* (2013.01); *G09G 2320/0261* (2013.01); *G09G 2320/064* (2013.01)

(56) References Cited

U.S. PATENT DOCUMENTS

| | | | | |
|---|---|---|---|---|
| 2002/0008685 | A1* | 1/2002 | Ban et al. | 345/92 |
| 2002/0122020 | A1* | 9/2002 | Moon et al. | 345/89 |
| 2003/0169247 | A1* | 9/2003 | Kawabe et al. | 345/204 |
| 2003/0218587 | A1* | 11/2003 | Ikeda | 345/87 |
| 2004/0041760 | A1* | 3/2004 | Tsumura et al. | 345/87 |
| 2005/0219188 | A1* | 10/2005 | Kawabe et al. | 345/94 |
| 2006/0238486 | A1* | 10/2006 | Hiraki | 345/102 |
| 2006/0256069 | A1* | 11/2006 | Okazaki | 345/102 |
| 2007/0057959 | A1 | 3/2007 | Cho et al. | |
| 2007/0222740 | A1 | 9/2007 | Hanada | |
| 2007/0229432 | A1 | 10/2007 | Kimura | |
| 2008/0013126 | A1* | 1/2008 | Tseng et al. | 358/3.01 |
| 2008/0018587 | A1* | 1/2008 | Honbo et al. | 345/102 |
| 2008/0055229 | A1* | 3/2008 | Shen et al. | 345/102 |
| 2008/0055231 | A1* | 3/2008 | Nose et al. | 345/102 |
| 2008/0068359 | A1* | 3/2008 | Yoshida et al. | 345/204 |
| 2008/0129673 | A1 | 6/2008 | Kim et al. | |
| 2008/0284768 | A1* | 11/2008 | Yoshida et al. | 345/208 |
| 2009/0102771 | A1* | 4/2009 | Sugisawa et al. | 345/89 |
| 2009/0184916 | A1* | 7/2009 | Miyazaki et al. | 345/102 |
| 2009/0243995 | A1* | 10/2009 | Kimura | 345/102 |

FOREIGN PATENT DOCUMENTS

| | | | |
|---|---|---|---|
| CN | 101029986 | A | 9/2007 |
| JP | 2008-151989 | A | 7/2008 |
| JP | 2009-109736 | A | 5/2009 |
| TW | 200410189 | A | 6/2004 |
| TW | 200643865 | A | 12/2006 |

OTHER PUBLICATIONS

KIPO—Office Action for Korean Patent Application No. 10-2010-0023893—Issued on Mar. 28, 2013.

TIPO: Office Action for Taiwanese Patent Application No. 099116386—Issued Oct. 16, 2013—Including English Translation of Examination Statement.

Chinese Office Action (Application No. 201010502123.7), dated Jul. 11, 2012, with English translation.

* cited by examiner

LIQUID CRYSTAL DISPLAY AND METHOD FOR DRIVING THE SAME

This application claims the benefit of Korean Patent Application No. 10-2009-101429 filed on Oct. 23, 2009 and Korean Patent Application No. 10-2010-0023893 filed on Mar. 17, 2010, which are incorporated herein by reference.

BACKGROUND OF THE INVENTION

1. Field of the Invention

The present invention relates to a liquid crystal display, and more particularly, to a liquid crystal display and a method for driving the same capable of improving a motion picture response time (MPRT) performance.

2. Discussion of the Related Art

An active matrix type liquid crystal display displays a motion picture using a thin film transistor (TFT) as a switching element. The active matrix type liquid crystal display has been implemented in televisions as well as display devices in portable information devices, office equipment, computers, etc., because of its thin profile and high definition. Accordingly, cathode ray tubes are being rapidly replaced by the active matrix type liquid crystal displays.

When a liquid crystal display displays a motion picture, a motion blur resulting in an unclear and blurry screen may appear because of the characteristics of liquid crystals. A scanning backlight driving technology was proposed so as to improve a motion picture response time (MPRT) performance. As shown in FIGS. 1 and 2, the scanning backlight driving technology provides an effect similar to an impulsive drive of a cathode ray tube by sequentially turning on and off a plurality of light sources of a backlight unit along a scanning direction of display lines of a liquid crystal display panel and thus can solve the motion blur of the liquid crystal display. In FIGS. 1 and 2, the black regions show the portions where the light sources are off and the white regions show the portions where the light sources are on. However, the scanning backlight driving technology has the following problems.

First, because the light sources of the backlight unit are turned off for a predetermined time in each frame period in the scanning backlight driving technology, the screen becomes dark. As a solution thereto, a method for controlling the turn-off time of the light sources depending on the brightness of the screen may be considered. However, in this case, the improvement effect of the MPRT performance is reduced because the turn-off time is shortened or removed in the bright screen.

Second, light interference occurs in boundary portions of the scanning blocks because turn-on times or turn-off times of the light sources of the scanning blocks are different from one another in the scanning backlight driving technology.

Third, the formation location of the light sources of the backlight unit are limited because the scanning backlight driving technology can be successfully implemented by controlling light incident on the liquid crystal display panel in each of the scanning blocks. The backlight unit may be classified into a direct type backlight unit and an edge type backlight unit.

In the direct type backlight unit, a plurality of optical sheets and a diffusion plate are stacked under the liquid crystal display panel, and a plurality of light sources are positioned under the diffusion plate. Thus, it is easy to achieve the scanning backlight driving technology in the direct type backlight unit having the above-described structure.

On the other hand, in the edge type backlight unit, a plurality of light sources are positioned opposite the side of a light guide plate, and a plurality of optical sheets are positioned between the liquid crystal display panel and the light guide plate. In the edge type backlight unit, the light sources irradiate light onto one side of the light guide plate and the light guide plate has a structure capable of converting a line light source (or a point light source) into a surface light source. In other words, the characteristics of the light guide plate are such that the light irradiated onto one side of the light guide plate spreads on all sides of the light guide plate. Therefore, it is difficult to control light incident on the liquid crystal display panel in each of the display blocks and hence, it is difficult to achieve the scanning backlight driving technology in the edge type backlight unit having the above-described structure.

SUMMARY OF THE INVENTION

Accordingly, the present invention is directed to a liquid crystal display and method for driving the same that substantially obviates one or more problems due to limitations and disadvantages of the related art.

An object of the present invention is to provide a liquid crystal display and a method for driving the same capable of improving a motion picture response time (MPRT) performance without light interference resulting from a difference between turn-on times or turn-off times of light sources.

Another object of the present invention is to provide a liquid crystal display and a method for driving the same capable of improving a MPRT performance without a reduction in a luminance of the liquid crystal display.

Another object of the present invention is to provide a liquid crystal display and a method for driving the same capable of improving a MPRT performance irrespective of locations of light sources constituting a backlight unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel including data lines and gate lines, a data driving circuit configured to drive the data lines, a gate driving circuit configured to drive the gate lines, a timing controller configured to divide a unit frame period into a first sub-frame period and a second sub-frame period, a backlight unit configured to provide light to the liquid crystal display panel wherein the backlight unit includes a plurality of light sources, and a light source driving circuit configured to turn off all the plurality of light sources during the first sub-frame period and turns on all the plurality of light sources at a turn-on time within the second sub-frame period.

In another aspect, the method of driving a liquid crystal display includes providing light to a liquid crystal display panel with a backlight unit including a plurality of light sources, dividing a unit frame period into a first sub-frame period and a second sub-frame period with a timing controller, and turning off all the plurality of light sources during the first sub-frame period and turning on all the plurality of light sources at a turn-on time within the second sub-frame period with a light source driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
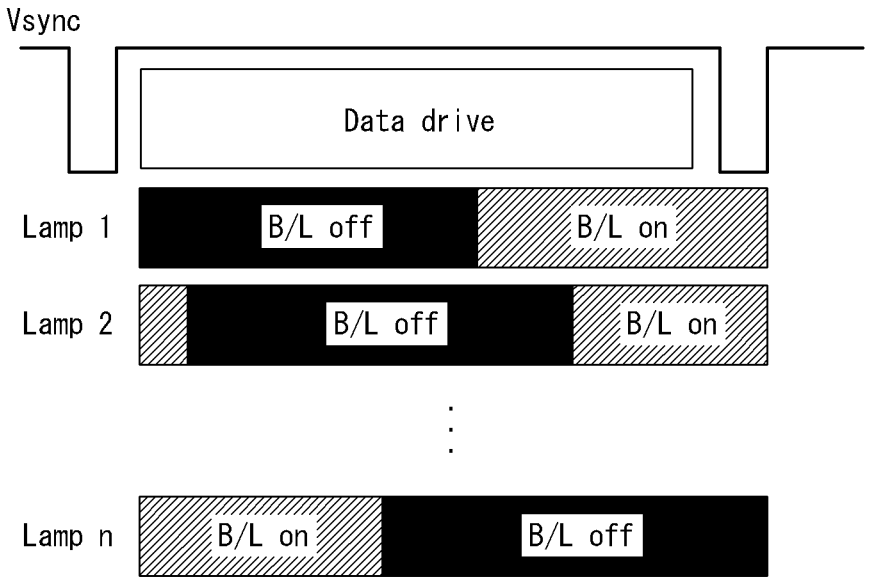
FIG. 1 (Related Art)
FIGS. 1 and 2 illustrate a related art scanning backlight driving technology.
Figure 2:
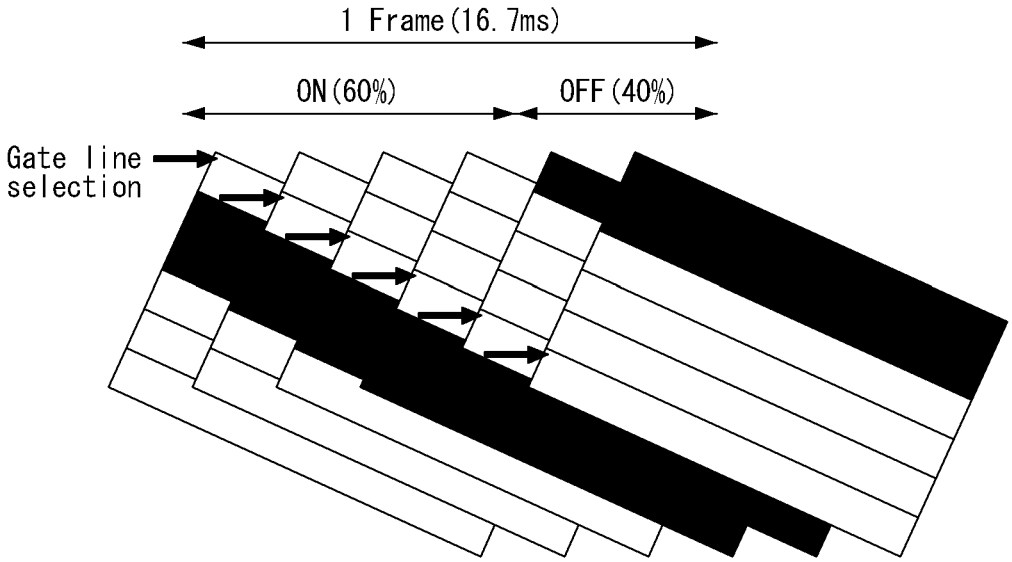
FIG. 2 (Related Art)
Figure 3:
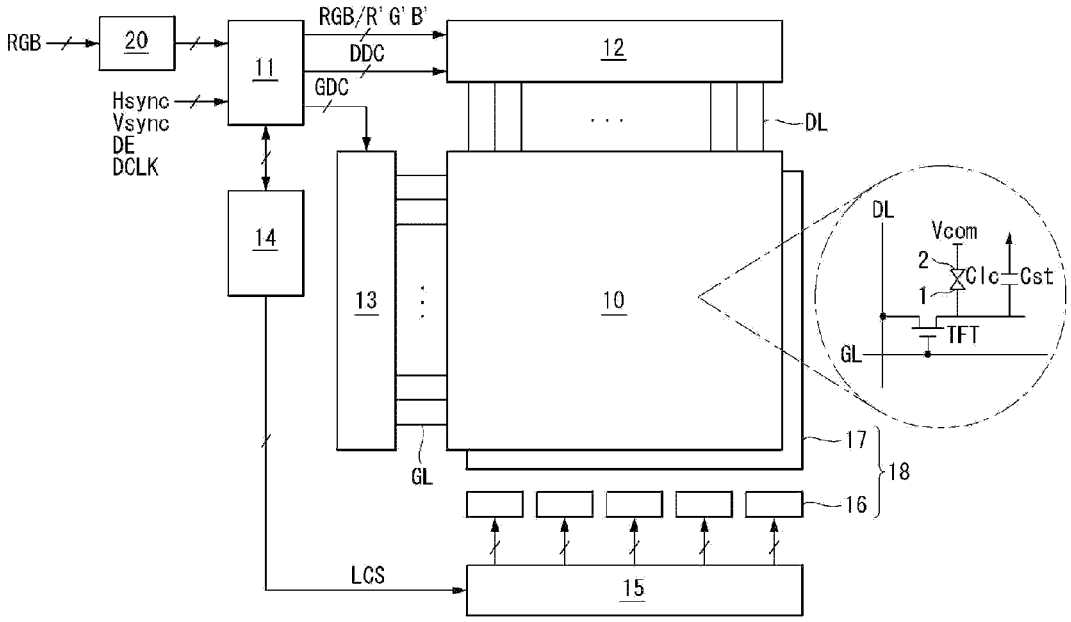
FIG. 3 illustrates a liquid crystal display according to an exemplary embodiment of the invention.

FIG. 3 illustrates a liquid crystal display according to an exemplary embodiment of the invention. As shown in FIG. 3, a liquid crystal display according to an embodiment of the invention includes a liquid crystal display panel 10, a data driving circuit 12 for driving data lines DL of the liquid crystal display panel 10, a gate driving circuit 13 for driving gate lines GL of the liquid crystal display panel 10, a timing controller 11 for controlling the data driving circuit 12 and the gate driving circuit 13, a frequency modulation circuit 20, a backlight unit 18 including a plurality of light sources 16 and providing light to the liquid crystal display panel 10, a light source control circuit 14 generating a light source control signal LCS, and a light source driving circuit 15 for driving the plurality of light sources 16 in response to the light source control signal LCS, wherein the light source driving circuit is capable of turning on and off all of the light sources 16 in a blinking manner.

The liquid crystal display panel 10 includes an upper glass substrate (not shown), a lower glass substrate (not shown), and a liquid crystal layer (not shown) between the upper and lower glass substrates. The plurality of data lines DL and the plurality of gate lines GL cross one another on the lower glass substrate of the liquid crystal display panel 10. A plurality of liquid crystal cells Clc are arranged on the liquid crystal display panel 10 in a matrix form in accordance with the data lines DL and the gate lines GL crossing each other. Thin film transistors TFT, pixel electrodes 1 of the liquid crystal cells Clc connected to the thin film transistors TFT, storage capacitors Cst are formed on the lower glass substrate of the liquid crystal display panel 10.

A black matrix (not shown), a color filter (not shown), and a common electrode 2 are formed on the upper glass substrate of the liquid crystal display panel 10. The common electrode 2 can be formed on the upper glass substrate in a vertical electric field driving manner, such as a twisted nematic (TN) mode and a vertical alignment (VA) mode. The common electrode 2 and the pixel electrode 1 can be formed on the lower glass substrate in a horizontal electric field driving manner, such as an in-plane switching (IPS) mode and a fringe field switching (FFS) mode. Polarizing plates (not shown) are respectively attached to the upper and lower glass substrates of the liquid crystal display panel 10. Alignment layers (not shown) for setting a pre-tilt angle of liquid crystals are respectively formed the inner surfaces of the upper and lower glass substrates contacting the liquid crystals.

Figure 9:
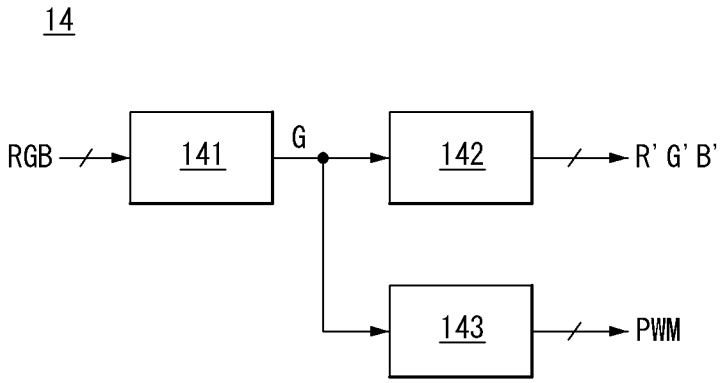
FIG. 9 illustrates a configuration of a light source control circuit according to the exemplary embodiment of the present invention.

The data driving circuit 12 includes a plurality of data driver integrated circuits (ICs). Each of the data driver ICs includes a shift register for sampling a clock, a register for temporarily storing unit frame data, a latch that stores data corresponding to one line in response to the clock received from the shift register and simultaneously outputs the data each corresponding to one line, a digital-to-analog converter (DAC) for selecting a positive or negative gamma voltage based on a gamma reference voltage corresponding to the digital data received from the latch, a multiplexer for selecting the data line DL receiving analog data converted from the positive/negative gamma voltage, an output buffer connected between the multiplexer and the data lines DL, and the like. In FIG. 3, unit frame data R'G'B' indicates modulation data for expanding a dynamic range of data displayed on the liquid crystal display panel 10 when global dimming or local dimming is performed as shown in FIG. 9. The modulation data R'G'B' is described later with reference to FIG. 9.

The data driving circuit 12 latches the unit frame data RGB under the control of the timing controller 11 and converts the latched unit frame data RGB into a positive or negative analog data voltage using a positive or negative gamma compensation voltage. The data driving circuit 12 then supplies the positive/negative analog data voltage to the data lines DL. The above operation of the data driving circuit 12 is successively performed during a first sub-frame period corresponding to a first half period of one frame period and a second sub-frame period corresponding to a second half period of the one frame period.

The gate driving circuit 13 includes a plurality of gate driver ICs. Each of the gate driver ICs includes a shift register, a level shifter for converting an output signal of the shift register into a swing width suitable for a TFT drive of the liquid crystal cells, an output buffer, and the like. The gate driving circuit 13 sequentially outputs a gate pulse (or a scan pulse) under the control of the timing controller 11 to supply the gate pulse to the gate lines GL. The above operation of the gate driving circuit 13 is performed in each of the first sub-frame period and the second sub-frame period.

The timing controller 11 receives timing signals Vsync, Hsync, DE, and DCLK from an external system board to generate a data control signal DDC and a gate control signal GDC for respectively controlling operation timings of the data driving circuit 12 and the gate driving circuit 13 based on the timing signals Vsync, Hsync, DE, and DCLK. The timing controller 11 multiplies the data control signal DDC and the gate control signal GDC to control operations of the data driving circuit 12 and the gate driving circuit 13 using a frame frequency of (unit frame frequency×N) Hz, where N is a positive integer equal to or greater than 2. In particular, N is the number of subframes. For example, the frame frequency is 240 Hz when the unit frame frequency is 120 and N is 2.

The timing controller 11 copies the unit frame data RGB received from the external system board every 1 frame period using a frame memory. Then, the timing controller 11 synchronizes the original unit frame data RGB and the copied unit frame data RGB with the multiplied frame frequency to repeatedly supply the same frame data to the data driving circuit 12 during the first and second sub-frame periods. In other words, in one frame period, the original unit frame data RGB is displayed on the screen during the first sub-frame period, and the copied unit frame data RGB is displayed on the screen during the second sub-frame period.

The backlight unit may be implemented as one of an edge type backlight unit and a direct type backlight unit. Because the embodiment of the invention drives the light sources in a blinking manner so as to improve a motion picture response time (MPRT) performance, the formation location of the light sources constituting the backlight unit are not limited. Although FIG. 3 shows an edge type backlight unit, the embodiment of the invention is not limited to the edge type backlight unit and may use any known backlight unit. The edge type backlight unit 18 includes a light guide plate 17, the plurality of light sources 16 irradiating light onto the side of the light guide plate 17, and a plurality of optical sheets stacked (not shown) between the light guide plate 17 and the liquid crystal display panel 10.

Figure 4A:
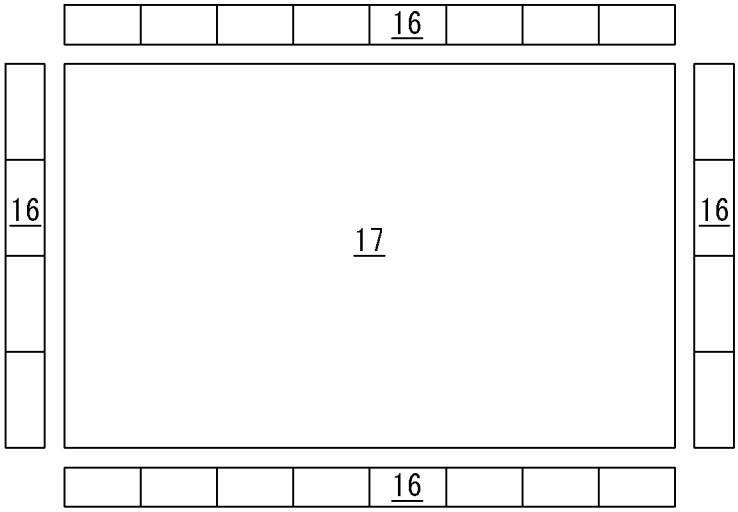
FIGS. 4A to 4D illustrate locations of light sources of a backlight unit according to the exemplary embodiment of the present invention.
Figure 4B:
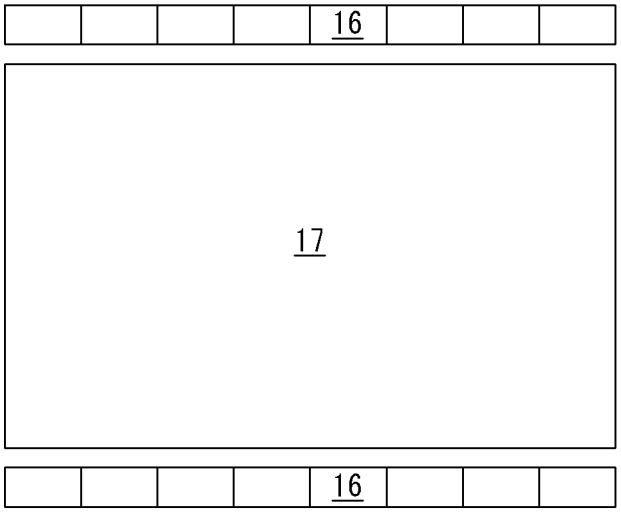
Figure 4C:
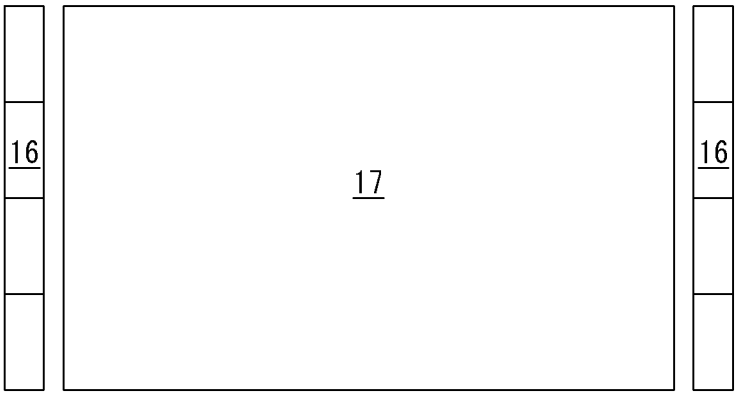
Figure 4D:
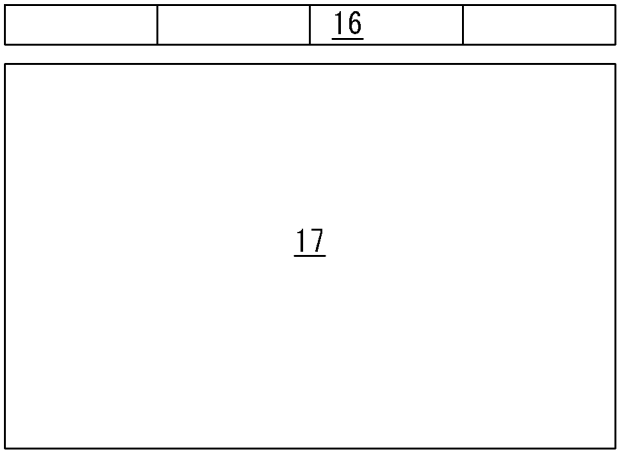

In the edge type backlight unit according to an exemplary embodiment of the invention, the light sources 16 may be positioned at at least one side of the light guide plate 17. For example, the light sources 16 may be positioned at four sides of the light guide plate 17 as shown in FIG. 4A or may be positioned at upper and lower sides of the light guide plate 17 as shown in FIG. 4B. Alternatively, the light sources 16 may be positioned at right and left sides of the light guide plate 17 as shown in FIG. 4C or may be positioned at one side of the light guide plate 17 as shown in FIG. 4D. The light sources 16 may be implemented as one of a cold cathode fluorescent lamp (CCFL), an external electrode fluorescent lamp (EEFL), and a light emitting diode (LED). Preferably, the light sources 16 may be implemented as the LED whose a luminance immediately varies depending on an adjustment of a driving current. The light guide plate 17 may have at least one of various types of patterns including a plurality of depressed patterns or embossed patterns, prism patterns, and lenticular patterns, and the at least one of the various types of patterns is formed on an upper surface and/or a lower surface of the light guide plate 17. The patterns of the light guide plate 17 may secure rectilinear propagation of a light path and may control a brightness of the backlight unit 18 in each local area. The optical sheets include at least one prism sheet and at least one diffusion sheet to diffuse light from the light guide plate 17 and to refract the travel path of light traveling substantially perpendicular to the light incident surface of the liquid crystal display panel 10. The optical sheets may include a dual brightness enhancement film (DBEF).

The light source control circuit 14 generates the light source control signal LCS including a pulse width modulation (PWM) signal for controlling turn-on time of the light sources 16 and a current control signal for controlling a driving current of the light sources 16. A maximum duty ratio of the PWM signal may be previously set within a range equal to or less than 50%, so that the MPRT performance can be improved. A level of the driving current of the light sources 16 may be previously set, so that the level of the driving current is inversely proportional to the maximum duty ratio of the PWM signal. More specifically, as the maximum duty ratio of the PWM signal decreases, the level of the driving current increases. The inversely proportional relationship between the maximum duty ratio of the PWM signal and the level of the driving current is to compensate for a reduction in a luminance of the screen resulting from an increase in turn-off time of the light sources 16 in one frame period for improving the MPRT performance. The driving currents, each having a different level depending on the maximum duty ratio of the PWM signal, are described later with reference to FIG. 8. A duty ratio of the PWM signal may vary depending on an input image within a range equal to or less than the previously set maximum duty ratio. In this case, the light source control circuit 14 analyzes the input image and adjusts the duty ratio of the PWM signal according to the result of an analysis of the input image to thereby perform global dimming or local dimming. During the global or local dimming, the light source control circuit 14 adjusts the duty ratio of the PWM signal and modulates the input data thereby expanding a dynamic range of the input image. The light source control circuit 14 may be mounted inside the timing controller 11.

The light source control signal LCS includes turn-on times and turn-off times of the light sources 16. The light source driving circuit 15 turns off all of the light sources 16 during the first sub-frame period and turns on all of the light sources 16 during the second sub-frame period in response to the light source control signal LCS thereby driving the light sources 16 in a blinking manner.

The frequency modulation circuit 20 is configured to modulate the unit frame frequency to prevent flickering. In particular, the frequency modulation circuit 20 inserts interpolation frames into the input frame data provided from the video source to generate a unit frame data. For example, the frequency modulation circuit 20 can modulate the input frame data with a frequency of 60 Hz into a unit frame data with a frame frequency of 120 Hz by inserting one interpolation frame for each input frame data. Alternatively, the frequency modulation circuit 20 can modulate the input frame data with a frequency of 60 Hz into a unit frame data with a frame frequency of 75 Hz by inserting one interpolation frame for every four input frame data. The frequency modulation circuit 20 then provides the unit frame data to the timing controller 11. The frequency modulation circuit 20 can be formed within an external system circuit (not shown). When the frame frequency is 75 Hz, there is an additional advantage in that the number of transmission ports between the frequency modulation circuit 20 and the timing controller can be reduced to less than half as compared with when the frame frequency is 120 Hz because the data bandwidth decreases.

Figure 5:
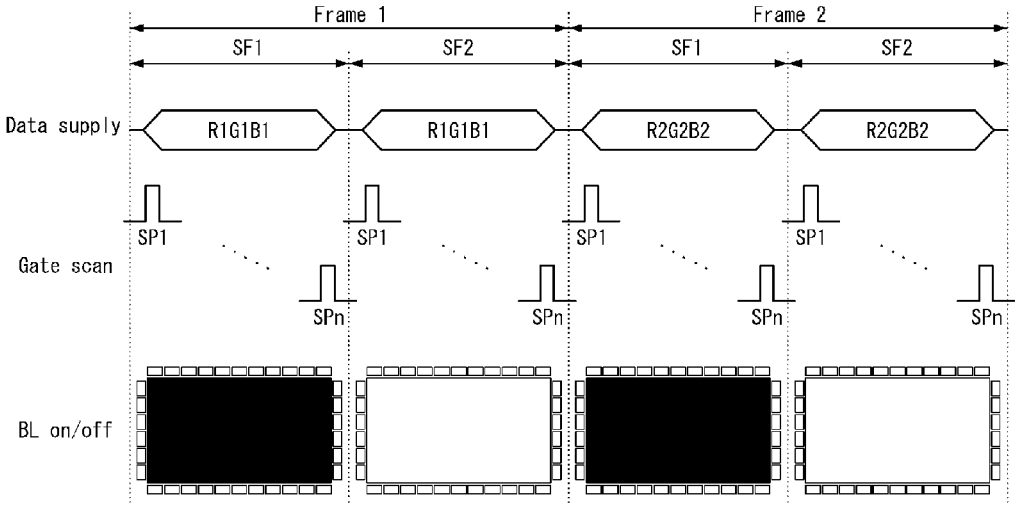
FIGS. 5 to 7 illustrate data write and turn-on times and turn-off times of light sources for improving a motion picture response time (MPRT) performance according to the exemplary embodiment of the present invention.
Figure 6:
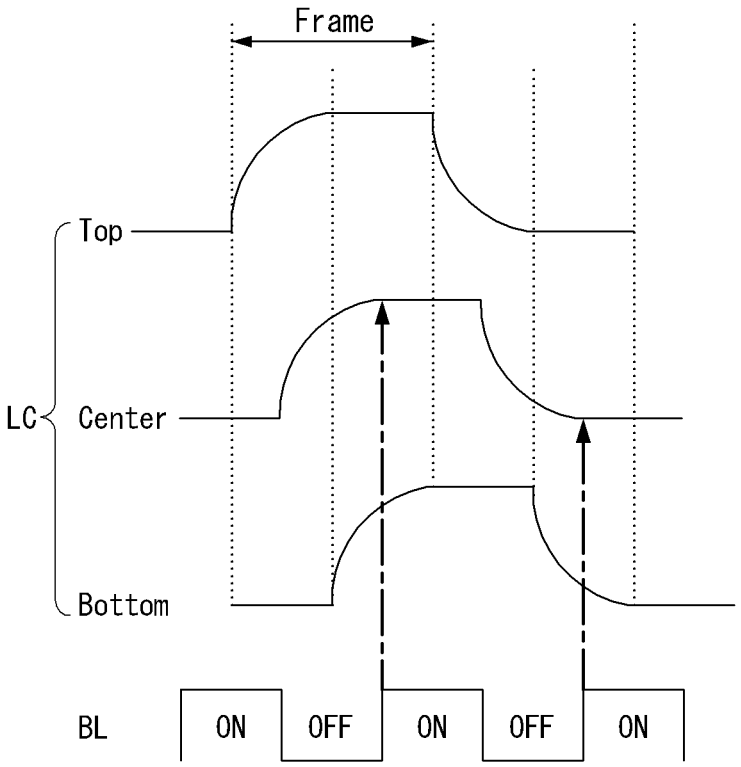
Figure 7:
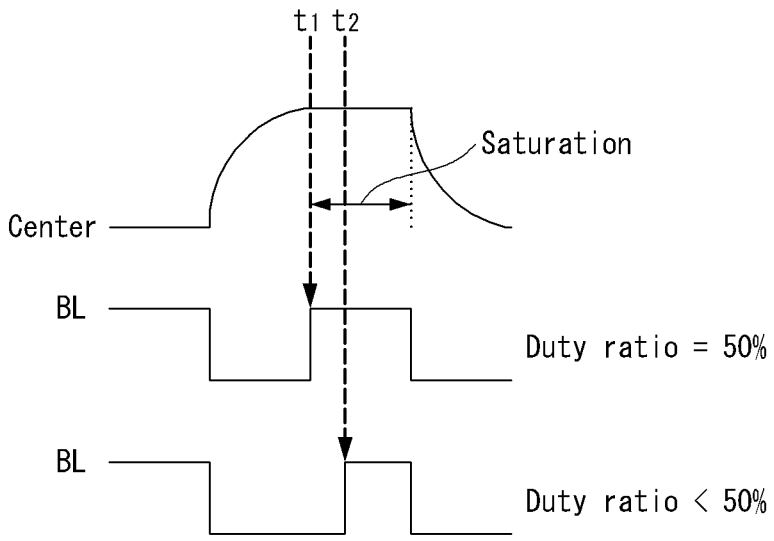

FIGS. 5 to 7 illustrate data write and turn-on time and turn-off time of the light sources for improving the MPRT performance.

As shown in FIG. 5, the exemplary embodiment of the invention controls the data driving circuit and the gate driving circuit using a frame frequency obtained by multiplying an input frame frequency by 2 to thereby time-division drive one frame period into a first sub-frame period SF1 and a second sub-frame period SF1. Original data corresponding to one frame is displayed on the liquid crystal display panel during the first sub-frame period SF1, and copied data (equal to the original data) corresponding to one frame is displayed on the liquid crystal display panel during the second sub-frame period SF2. The light sources remain in a turn-off state during the first sub-frame period SF1 and then are turned on during the second sub-frame period SF2.

As shown in FIG. 6, the light sources are simultaneously turned on after liquid crystals LC in a middle portion of the liquid crystal display panel are saturated in a corresponding frame. Saturation time of the liquid crystals LC is delayed as the liquid crystal display panel goes from the top to the bottom of the liquid crystal display panel in conformity with the scanning order of the liquid crystal display panel. The turn-on time of the light sources is determined based on time at which the liquid crystals LC in the middle portion of the liquid crystal display panel are saturated, so as to reduce a difference between the saturation time of the liquid crystals LC and the turn-on time of the light sources throughout the entire area of the liquid crystal display panel. In the exemplary embodiment of the invention, when data synchronized with the multiplied frame frequency is addressed over the entire area of the liquid crystal display panel, time required to address the entire area of the liquid crystal display panel using the multiplied frame frequency is reduced by one half the time required to address the entire area of the liquid crystal display panel before the multiplication operation. Accordingly, in the exemplary embodiment of the invention, because a frame period remaining after the data addressing may be assigned to a liquid crystal response, a time difference assigned to the liquid crystal response in the entire area of the liquid crystal display panel may be greatly reduced. Hence, uniformity of the MPRT may increase. Further, in the exemplary embodiment of the invention, because the same data is addressed two times in one frame period, after the liquid crystals are saturated, the liquid crystals can remain in a stable saturation state. In the exemplary embodiment of the invention, when the light sources are turned on during the second sub-frame period SF2 in which the liquid crystals remain in the saturation state, the difference between the saturation time of the liquid crystals LC and the turn-on time of the light sources may be greatly reduced throughout the entire area of the liquid crystal display panel.

As shown in FIG. 7, the turn-on times of the light sources 16 may vary depending on the duty ratio of the PWM signal after the liquid crystals in the middle portion of the liquid crystal display panel 10 are saturated in response to the input data of the current frame. In particular, the turn-on time of the light sources may vary depending on the maximum duty ratio of the PWM signal in the second sub-frame period SF2. For example, the turn-on time of the light sources may be determined as a first time point t1 so as to achieve a maximum duty ratio of 50% and may be determined as a second time point t2 later than the first time point t1 so as to achieve a maximum duty ratio smaller than 50%. On the other hand, the turn-off times of the light sources 16 may be fixed to be immediately before the time in which data of the next frame is written in the middle portion of the liquid crystal display panel 10.

Figure 8:
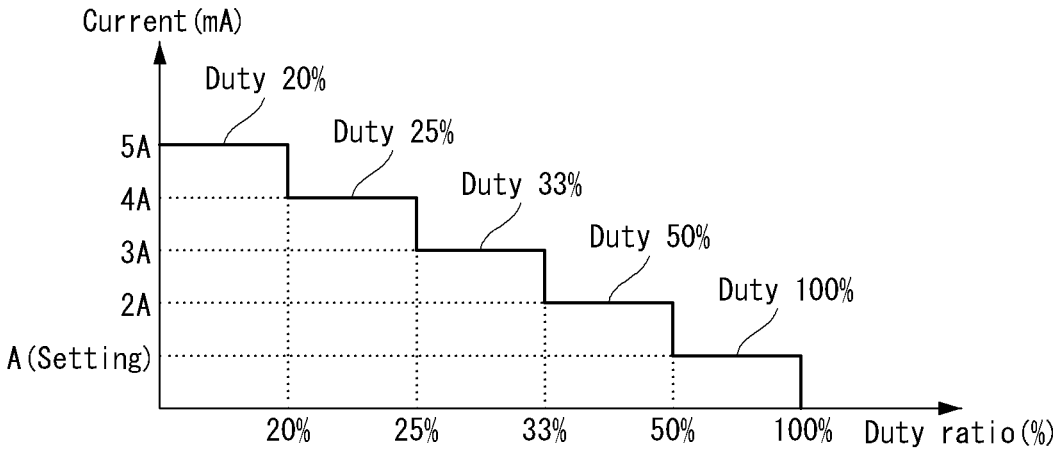
FIG. 8 illustrates exemplary levels of the driving current varying depending on a duty ratio of a pulse width modulation (PWM) signal according to the exemplary embodiment of the present invention.

FIG. 8 illustrates variation of levels of the driving current depending on the maximum duty ratio of the PWM signal to compensate for a luminance reduction in the blinking manner. As shown in FIG. 8, a level of the driving current is inversely proportional to the maximum duty ratio of the PWM signal. For example, when the reference current level A is defined to be the current level when maximum duty ration of the PWM is 100%, the level of the driving current may be set at a value (i.e., 2 A) corresponding to two times the reference current level A when the maximum duty ratio of the PWM signal is 50%; a value (i.e., 3 A) corresponding to three times the reference current level A when the maximum duty ratio of the PWM signal is 33%; a value (i.e., 4 A) corresponding to four times the reference current level A when the maximum duty ratio of the PWM signal is 25%; and a value (i.e., 5 A) corresponding to five times the reference current level A when the maximum duty ratio of the PWM signal is 20%. In FIG. 8, the reference current level A, which is the current level corresponding to 100% maximum duty ratio of the PWM signal, is previously stored in a specific register of the light source control circuit 14.

FIG. 9 illustrates a configuration of the light source control circuit 14 for improving the MPRT performance and performing global diming or local diming. As shown in FIG. 9, the light source control circuit 14 includes a data analysis unit 141, a data modulation unit 142, and a duty adjusting unit 143.

The data analysis unit 141 calculates a histogram (i.e., a cumulative distribution function) of the data RGB of the input image and calculates a frame representative value from the histogram. The frame representative value may be calculated using a mean value, a mode value (indicating a value that occurs the most frequently in the histogram), etc. of the histogram. The frame representative value may be calculated based on the entire screen of the liquid crystal display panel 10 in the global dimming and may be calculated based on each of predetermined blocks in the local dimming. The data analysis unit 141 determines a gain value G depending on the frame representative value. The gain value G is supplied to the data modulation unit 142 and the duty adjusting unit 143. The gain value G may be determined as a large value as the frame representative value increases and may be determined as a small value as the frame representative value decreases.

The data modulation unit 142 modulates the unit frame data RGB based on the gain value G received from the data analysis unit 141 to expand a dynamic range of data input to the liquid crystal display panel 10. As the gain value G received from the data analysis unit 141 increases, an upward modulation width of the unit frame data RGB may increase. Further, as the gain value G received from the data analysis unit 141 decreases, a downward modulation width of the unit frame data RGB may increase. A data modulation operation of the data modulation unit 142 may be performed using a look-up table.

The duty adjusting unit 143 may adjust the duty ratio of the PWM signal depending on the gain value G received from the data analysis unit 141. The duty ratio of the PWM signal is determined as a value proportional to the gain value G within a range equal to or less than the previously set maximum duty ratio. The duty ratio of the PWM signal may be adjusted based on the entire screen of the liquid crystal display panel or based on each of the blocks.

As described above, in the liquid crystal display and the method for driving the same according to the exemplary embodiment of the invention, the same data is displayed two times during one frame period that is divided into the first and second sub-frame periods, and all of the light sources are turned off during the first sub-frame period and then are turned on during the second sub-frame period. Further, the driving current of the light sources increases as the maximum duty ratio of the PWM signal decreases. Hence, the MPRT performance may be greatly improved without a reduction in a luminance of the liquid crystal display and without light interference resulting from a difference between turn-on times or turn-off times of the light sources.

Furthermore, in the liquid crystal display and the method for driving the same according to the embodiment of the invention, because the light sources are blinkingly driven so as to improve the MPRT performance, it is possible to blinkingly drive the light sources even when an edge type backlight unit is used in the liquid crystal display according to the embodiment of the invention. The edge type backlight unit may be thinner than a direct type backlight unit in which a sufficient interval between light sources and a diffusion plate is required for light diffusion. Thus, the edge type backlight unit may contribute to the thin profile of the liquid crystal display.

It will be apparent to those skilled in the art that various modifications and variations can be made in the liquid crystal display and method for driving the same of the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel including data lines and gate lines;

a data driving circuit configured to drive the data lines;

a gate driving circuit configured to drive the gate lines;

a timing controller configured to divide a unit frame period into:

a first sub-frame period; and a second sub-frame period, equal in length to the first sub-frame period;

a backlight unit configured to provide light to the liquid crystal display panel by using a plurality of light sources;

a light source driving circuit configured to:

turn off all the plurality of light sources during the first sub-frame period; and turn on all the plurality of light sources within the second sub-frame period; and a light source control circuit configured to generate a pulse width modulation signal to control a turn-on time of the plurality of light sources, wherein the timing controller is further configured to synchronize an input data and a copied data to repeatedly supply a same data to the data driving circuit during the first and second sub-frame periods, wherein a start point of the turn-on time depends on a duty ratio of the pulse width modulation signal after the liquid crystals in a middle portion of the liquid crystal display panel are saturated in response to a unit frame data, wherein an end point of the turn-on time is fixed to be immediately before a time in which data of a next frame is written in the middle portion of the liquid crystal display panel, wherein a level of a driving current driving the plurality of light sources is inversely proportional to a maximum duty ratio of the pulse width modulation signal output from the light source control circuit, wherein the light source control circuit comprises:

a data analysis unit configured to calculate a frame representative value, a data modulation unit configured to modulate a unit frame data based on the frame representative value, and a duty adjusting unit configured to adjust the duty ratio of the pulse width modulation signal based on the frame representative value, and wherein the backlight unit includes a light guide plate having one of a plurality of depressed patterns, embossed patterns, prism patterns, and lenticular patterns.

2. The liquid crystal display in claim 1, wherein the timing controller controls an operation timing of the data driving circuit and the gate driving circuit using a frame frequency of (unit frame frequency)×N, where N is a positive integer equal to or greater than 2.

3. The liquid crystal display in claim 1, wherein the backlight unit is an edge type backlight unit wherein the plurality of light sources are disposed at at least one side of a light guide plate within the backlight unit.

4. The liquid crystal display in claim 1, wherein the backlight unit is a direct type backlight unit.

5. The liquid crystal display in claim 1, wherein a unit frame data is provided to the data driving circuit during the first sub-frame period and a copied data is provided to the data driving circuit during the second sub-frame period.

6. The liquid crystal display in claim 1, further comprising a frequency modulation circuit configured to insert interpolation frames into an input frame data provided from a video source to generate a unit frame data.

7. The liquid crystal display in claim 1, wherein the timing controller controls an operation timing of the data driving circuit and the gate driving circuit using a frame frequency greater than a unit frame frequency.

8. The liquid crystal display in claim 7, wherein the unit frame frequency is equal to or greater than 75 Hz.

9. A method of driving a liquid crystal display, the method comprising:

providing light to a liquid crystal display panel with a backlight unit including a plurality of light sources;

dividing a unit frame period into:

a first sub-frame period; and a second sub-frame period, equal in length to the first sub-frame period;

synchronizing an input data and a copied data to repeatedly supply a same data to the data driving circuit during the first and second sub-frame periods;

turning off all the plurality of light sources during the first sub-frame period with a light source driving circuit;

turning on all the plurality of light sources within the second sub-frame period with a light source driving circuit; and generating a pulse width modulation signal to control a turn-on time of the plurality of light sources with a light source control circuit, wherein a start point of the turn-on time depends on a duty ratio of the pulse width modulation signal after the liquid crystals in a middle portion of the liquid crystal display panel are saturated in response to a unit frame data, wherein an end point of the turn-on time is fixed to be immediately before a time in which data of a next frame is written in the middle portion of the liquid crystal display panel, wherein a level of a driving current driving the plurality of light sources is inversely proportional to a maximum duty ratio of the pulse width modulation signal, and wherein the generating a pulse width modulation signal comprises, by the light source control circuit:

calculating a frame representative value, modulating a unit frame data based on the frame representative value, and adjusting the duty ratio of the pulse width modulation signal based on the frame representative value, and wherein the backlight unit includes a light guide plate having one of a plurality of depressed patterns, embossed patterns, prism patterns, and lenticular patterns.

10. The method of claim 9, wherein a level of a driving current driving the plurality of light sources is inversely proportional to a maximum duty ratio of a pulse width modulation signal output from the light source control circuit.

* * * * *